US005201360A

United States Patent [19]

Schenk et al.

[11] Patent Number: 5,201,360

[45] Date of Patent: Apr. 13, 1993

[54] CASTING WHEEL FOR A SINGLE-ROLL CASTING MACHINE

[75] Inventors: Horst Schenk, Dortmund; Herbert Gellenbeck, Hemer, both of German Democratic Rep.

[73] Assignee: Sundwiger Eisenhutte Maschinenfabrik, Hemer-Sundwig, Fed. Rep. of Germany

[21] Appl. No.: 938,542

[22] Filed: Aug. 28, 1992

Related U.S. Application Data

[63] Continuation of Ser. No. 744,953, Aug. 14, 1991, abandoned.

[30] Foreign Application Priority Data

Aug. 17, 1990 [DE] Fed. Rep. of Germany ..... 4026075

[51] Int. Cl.[5] ..... B22D 11/06

[52] U.S. Cl. ..... 164/429; 164/427; 164/479

[58] Field of Search ..... 164/429, 427, 433, 479, 164/482, 443, 442, 448

[56] References Cited

U.S. PATENT DOCUMENTS

| | | | |
|---|---|---|---|
| 3,802,044 | 4/1974 | Spillmann et al. | 29/113.2 |
| 4,167,964 | 9/1979 | Flury | 164/448 |
| 4,307,771 | 12/1981 | Draizen et al. | 164/427 |
| 4,537,239 | 8/1985 | Budzyn et al. | 164/429 |
| 4,721,154 | 1/1988 | Christ et al. | 164/479 |

OTHER PUBLICATIONS

Buch E. Herrmann, Handbuch des Stranggiessbens, Aluminium-Verlag, Dusseldorf 1958, pp. 93, 95.

*Primary Examiner*—Richard K. Seidel
*Assistant Examiner*—Erik R. Puknys
*Attorney, Agent, or Firm*—Marmorek, Guttman and Rubenstein

[57] ABSTRACT

The invention relates to a casting wheel having an interchangeable casting ring 8. The casting ring 8 is secured on an inner member 7 of the casting wheel 1 by adjustable radially and outwardly acting pressure members 17, 18 engaging with the edges of the casting ring 8. The pressure members 17, 18 center the casting ring 8, which they secure axially. The casting ring can be mounted in a problem-free manner when the pressure members are relieved of pressure.

13 Claims, 2 Drawing Sheets

CASTING WHEEL FOR A SINGLE-ROLL CASTING MACHINE

This is a continuation of application Ser. No. 07/744,953, filed Aug. 14, 1991, now abandoned.

The invention relates to a casting wheel, more particularly for a single-roll machine, comprising an inner member and a casting ring which is secured thereon and which has an outer cylindrical generated surface, while provided under said generated surface is an axially extending annular space for a coolant to whose two edges coolant supply and discharge lines radially distributed over the periphery are connected.

Casting wheels of the kind specified are known. As a rule the axially extending annular space takes the form of axial bores distributed over the periphery in the casting ring. Coolant supply and discharge lines comprise chambers disposed on both sides of a central partition which forms part of the inner member and bears a rim-like outer member on which the casting ring is secured by means of screwed connections.

Such a casting wheel has a number of disadvantages. Due to screwed connections being used for securing purposes, it is an elaborate process to interchange the casting ring. Another consequence of this method of securing may be that the casting ring becomes deformed by thermal expansion and loses its circularity. Lastly, the casting ring itself is elaborate and relatively heavy due to the axial channels extending therethrough.

It is an object of the invention to provide a casting wheel of the kind specified whose very simply constructed casting ring can be readily interchanged on the inner member and which at least reduces the risk that the ring may become irregularly deformed by heat.

This problem is solved according to the invention by the feature that the casting ring is secured by adjustable radially and outwardly acting pressure members engaging on the inside with its two edges.

In the casting wheel according to the invention the casting ring is retained by pressure members acting radially on the ring, so that it remains centrally guided during thermal expansion. The pressure members at the same time ensure that the axial locking of the ring is also maintained. Since the pressure of the pressure members can be adjusted, the pressure can be so applied that the casting ring does not undergo polygonal deformation.

The pressure members should be made from a material having a low coefficient of thermal expansion. In that case the casting ring cannot become deformed by differential temperatures at the pressure members disposed at different places.

According to one feature of the invention the pressure members engage in internal annular grooves in the casting ring. Such engagement facilitates assembly, since it renders superfluous any peripheral association between the pressure members and the casting ring and also ensures the reliable axial fixing of the casting ring.

Preferably the pressure members are tensioning rods which extend in the inner member and whose tensioning force is acted upon centrally by an adjusting device. This design facilitates assembly and demounting, since the actuation of the adjusting device releases the casting ring from the inner member at all points of engagement of the pressure members. Constructionally this can be achieved in a very simple manner by the feature that the adjusting device acts via a tensioning wedge on the tensioning rods. A common tensioning wedge can be provided for all the tensioning rods. The independent unlocking of the pressure members when they are relieved of pressure by the tensioning wedge can be boosted by the feature that engaging with the pressure members are return springs which, when the pressure members are relieved of pressure by the tensioning wedge, move the pressure members out of engagement with the casting ring. Preferably an axially adjustable adjusting member is provided for the actuation of the tensioning wedge. The adjusting member can be a pneumatic or hydraulic actuator. More particularly if the casting ring is formed with internal annular grooves for the engagement of the pressure members, advantageously the annular space for the coolant is provided between the inner generated surface of the casting ring and the outer generated surface of the inner member.

An embodiment of the invention will now be described in greater detail with reference to the drawings, wherein.

Figure 1:
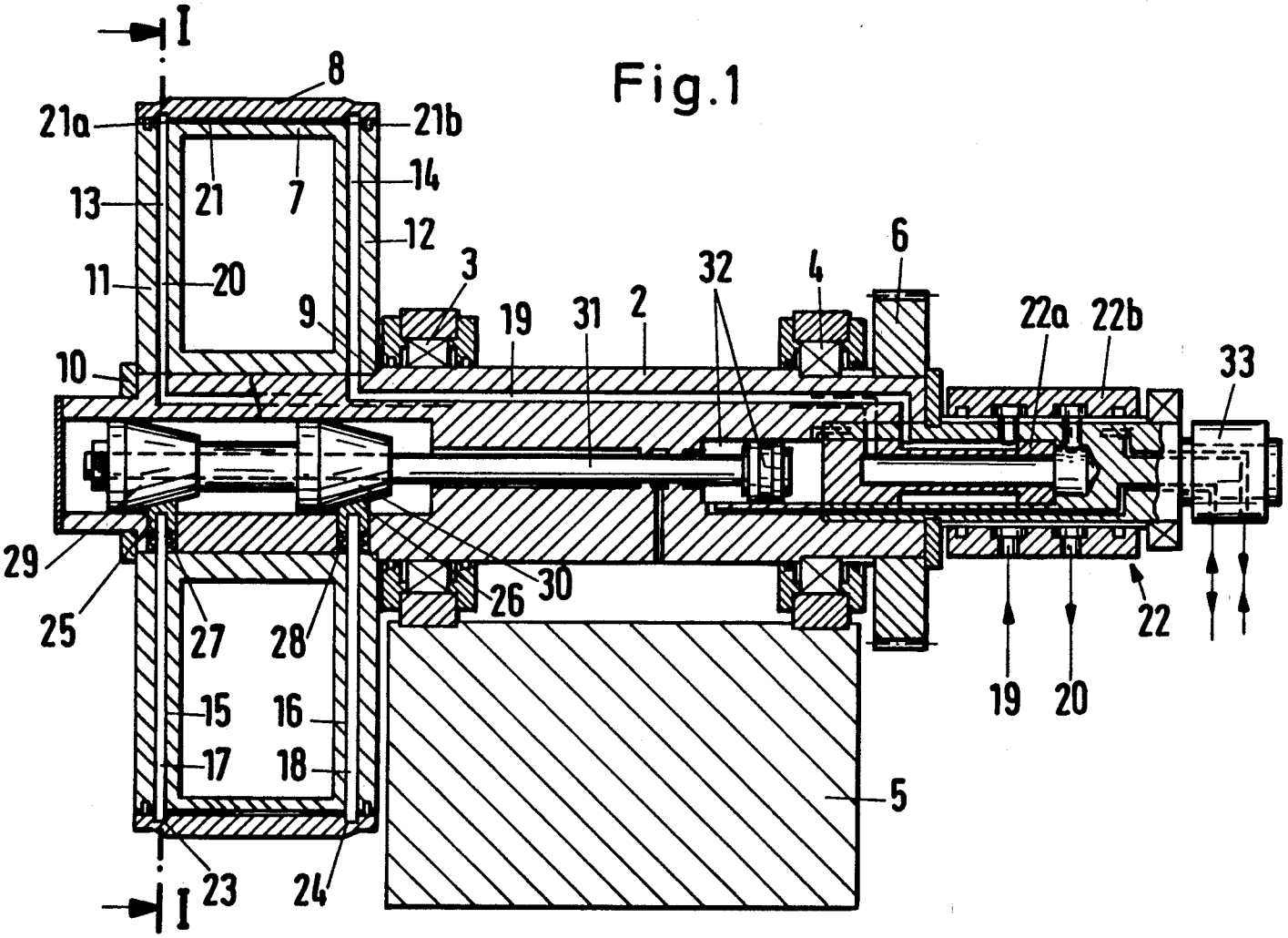
FIG. 1 is an axial section through a casting wheel.
Figure 2:
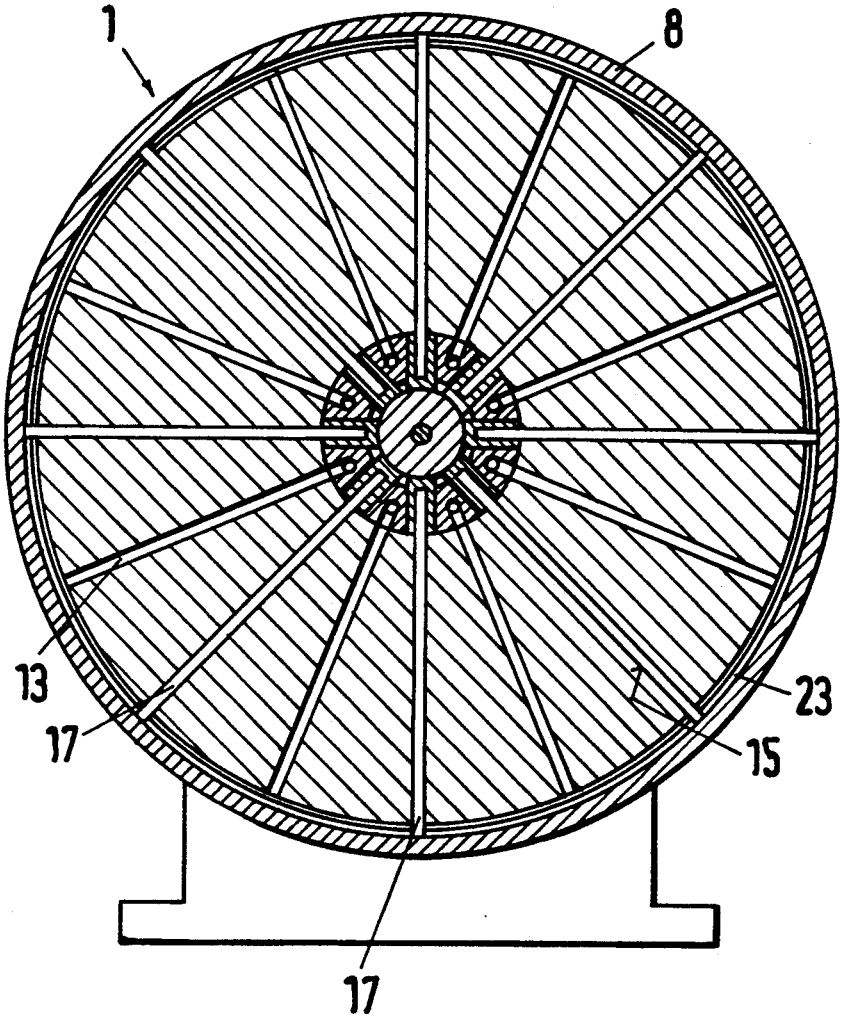
FIG. 2 is a cross-section, taken along the line I—I in FIG. 1, through the casting wheel illustrated in FIG. 1.

A casting wheel 1 with a driving shaft 2, on which the wheel is non-rotatably mounted, is rotatably mounted via bearings 3, 4 on a bearing block 5. The driving shaft 2 is driven by a driving wheel 6 non-rotatably disposed thereon.

The casting wheel comprises an inner member 7 and a casting ring 8 secured thereon. The inner member 7 is axially secured by a shoulder 9 of the driving shaft 2 and a ring 10 which can be attached to the driving shaft 2. The inner member 7 takes the form of a hollow member. Extending in its two end face walls 11, 12 are radial, peripherally distributed coolant bores 13, 14, radial bores 15, 16 being disposed therebetween for pressure members made of a material having a low coefficient of thermal expansion and taking the form of tensioning rods 17, 18. A suitable material is, for example, invar steel. The radial bores 13, 14 are connected to axial coolant supply lines 19 and discharge lines 20 in the driving shaft 2 and to an axial annular space 21 which is formed between the inner generated surface of the casting ring 8 and the outer generated surface of the inner member 7. The annular space 21 is sealed at each of its two axial edges by a seal **21*a*, 21*b* operating between the inner member 7 and the casting ring 8. This can be an inflatable seal which is pressure-monitored and connected to a pressure accumulator. This ensures that the annular space 21 remains closed even when the casting ring 8** expands.

The axial supply and discharge lines 19, 20 are connected to a corotating inner portion **22*a*, extending out of the driving shaft 2, of a distributor 22 to whose outer portion 22*b*** connections for coolant supply and removal can be connected.

The tensioning rods 17, 18 engage via their radially outer ends in annular grooves 23, 24 in the inner generated surface of the casting ring 8. As a result, the casting ring 8 is secured axially on the inner member 7 in any required position of rotation. Disposed on the tensioning rods 17, 18 at their inner ends are wedge members 25, 26 which are acted upon by springs 27, 28 in the direction of release of the tensioning rods 17, 18 and by central piston-shaped wedge members 29, 30 in the locking direction. The piston-shaped wedge members 29, 30 are disposed on a piston rod 31 of an actuator 32 which can be acted upon on both sides in the driving shaft 2. The actuator 32 is acted upon via a distributor 33 which, similarly to the distributor 22, comprises an inner corotating portion and an outer fixed portion. The wedge members 25, 26, 29, 30, the springs 27, 28 and the actuator 32 with the piston rod 31 form an adjusting device by means of which the pressure exerted on the casting ring 8 via the tensioning rods 17, 18 can be so adjusted that no undesirable polygonal deformation of the circular casting ring 8 takes place.

The casting ring 8 is assembled on the inner member 7 with the seals 21*a*, 21*b* relieved of pressure and the piston-shaped wedge members 29, 30 displaced to the left in relation to the drawings. In this position of the wedge membes 29, 30 the tensioning rods 17, 18 are retained by the springs 27, 28 in their radial inner end position. The casting ring 8 can therefore be slipped on unimpeded. After the axial positioning of the casting ring 8 the actuator 32 is operated, so that the wedge members 25, 26, 29, 30 become operative and move the tensioning rods 17, 18 into engagement in the annular grooves 23, 24. When the two seals 21*a*, 21*b* have been inflated, the coolant can be introduced into the annular space 21 and the casting wheel can commence operation.

We claim:

1. A casting wheel, comprising an annular inner member which is rotatable about an axis of rotation, a casting ring having an outer cylindrical generated surface, said casting ring being concentrically disposed about said inner member, an axially extending annular space which receives a coolant being located between said inner member and an inner surface of said casting ring, a radially extending supply line and a radially extending discharge line disposed in said inner member for supplying said coolant to said annular space, and radially adjustable and outwardly acting pressure members disposed in said inner member which engage against said inner surface of said casting ring thereby causing said casting ring to rotate with said inner member.

2. The casting wheel of claim 1 wherein said pressure members are made from a material having a low coefficient of thermal expansion.

3. The casting wheel of claim 1 wherein said pressure members comprise tension rods which exert a tensioning force on said casting ring.

4. The casting wheel of claim 3 further comprising adjustment means for adjusting said tensioning force.

5. The casting wheel of claim 4 wherein said adjustment means includes a centrally located tensioning wedge.

6. The casting wheel of claim 5 wherein said tensioning wedge acts on all of said tensioning rods simultaneously.

7. The casting wheel of claim 3 further comprising biasing means acting on said tension rods in a direction to relieve said tensioning force.

8. The casting wheel of claim 5 further comprising means for moving said tensioning wedge in an axial direction.

9. The casting wheel of claim 1 further comprising means for sealing said coolant in said annular space.

10. The casting wheel of claim 9 wherein said sealing means is inflatable.

11. The casting wheel of claim 9 wherein said sealing means is pressure-monitored.

12. The casting wheel of claim 1 wherein said pressure members engage against internal edges on said inner surface of said casting ring.

13. The casting wheel of claim 12 wherein said internal edges are part of internal annular grooves on said inner surface of said casting ring.

* * * * *